US008505294B2

(12) United States Patent
Willauer et al.

(10) Patent No.: US 8,505,294 B2
(45) Date of Patent: Aug. 13, 2013

(54) METHOD AND SYSTEM FOR CONTROL OF HYDRAULIC SYSTEMS

(75) Inventors: Darrin L. Willauer, The Woodlands, TX (US); Conrad G. Weinig, Missouri City, TX (US); Walter S. Going, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 1067 days.

(21) Appl. No.: 12/412,058

(22) Filed: Mar. 26, 2009

(65) Prior Publication Data

US 2010/0242718 A1 Sep. 30, 2010

(51) Int. Cl.
*F15B 7/10* (2006.01)

(52) U.S. Cl.
USPC ..... 60/564; 60/563; 60/329

(58) Field of Classification Search
USPC ..... 60/329, 563, 564
See application file for complete search history.

(56) References Cited

U.S. PATENT DOCUMENTS

| | | | | |
|---|---|---|---|---|
| 1,871,287 | A * | 8/1932 | Whittaker | 138/46 |
| 7,175,155 | B2 | 2/2007 | Takiguchi et al. | |
| 2001/0029736 | A1 * | 10/2001 | Geerts | 60/563 |

FOREIGN PATENT DOCUMENTS

| | | |
|---|---|---|
| JP | 2002-061606 | 2/2002 |
| JP | 2005-233265 | 9/2005 |
| JP | 2007-084331 | 4/2007 |

OTHER PUBLICATIONS

Hallibuton, Well Dynamics Transforming Reservoirs, How Direct Hydraulics Systems Work, www.welldynamics.com, Sep. 30, 2008, pp. 1-2.

Baker Hughes Incorporated, Neptune™ Series Nitrogen-Charged Subsurface Safety Valve, Advancing Reservoir Performance, Baker Oil Tools, p. 1.

* cited by examiner

*Primary Examiner* — F. Daniel Lopez
(74) *Attorney, Agent, or Firm* — Cantor Colburn LLP

(57) ABSTRACT

A hydraulic actuation system includes a metering valve; and a piston arrangement hydraulically in parallel with the metering valve, the system configured to preferentially move the piston to precharge an end device with hydraulic fluid prior to supplying an actuation fluid volume to the end device and method for actuating a hydraulic end device.

6 Claims, 2 Drawing Sheets

METHOD AND SYSTEM FOR CONTROL OF HYDRAULIC SYSTEMS

BACKGROUND

Utilization of a hydraulic fluid to actuate a device or system is nearly as old as engineering itself. The use of hydraulics allows for the relatively easy application of a first force in one location to be transferred to a remote location, to be translated into a higher or lower force using differential area, etc. In general hydraulic actuation is often fairly well controlled either by pressure control alone or through the use of a metering configuration such as a spool valve. In most conditions these types of control are reliable and hence hydraulic actuation is relied upon in many industries.

Although actuation of devices hydraulically can be fairly well controlled under most conditions, significant changes in ambient conditions such as temperature and/or high actuation pressures can render control less reliable and can have noticeable effects on the actuation process including the volume of hydraulic fluid required for completion of the intended movement. This can be especially true in devices or systems requiring actuation pressures in the hundreds or thousands of pounds per square inch (PSI) of pressure. These kinds of conditions and systems situations can be difficult to precisely control. Since precision control is sometimes very important to a particular type of actuation and because hydraulic actuation is a likely consideration is countless applications, the art is always interested in alternatives that improve precision control.

SUMMARY

A hydraulic actuation system includes a metering valve; and a piston arrangement hydraulically in parallel with the metering valve, the system configured to preferentially move the piston to precharge an end device with hydraulic fluid prior to supplying an actuation fluid volume to the end device.

A method for actuating a hydraulic end device includes pressuring a control line with parallel hydraulic access to a metering valve and a floating piston arrangement; stroking a piston of the piston arrangement if the piston arrangement is in a position that allows stroking; and stroking the metering valve after the piston arrangement is in a position that prevents further stroking of the piston.

BRIEF DESCRIPTION OF THE DRAWINGS

Referring now to the drawings wherein like elements are numbered alike in the several Figures.

DETAILED DESCRIPTION

Figure 1:
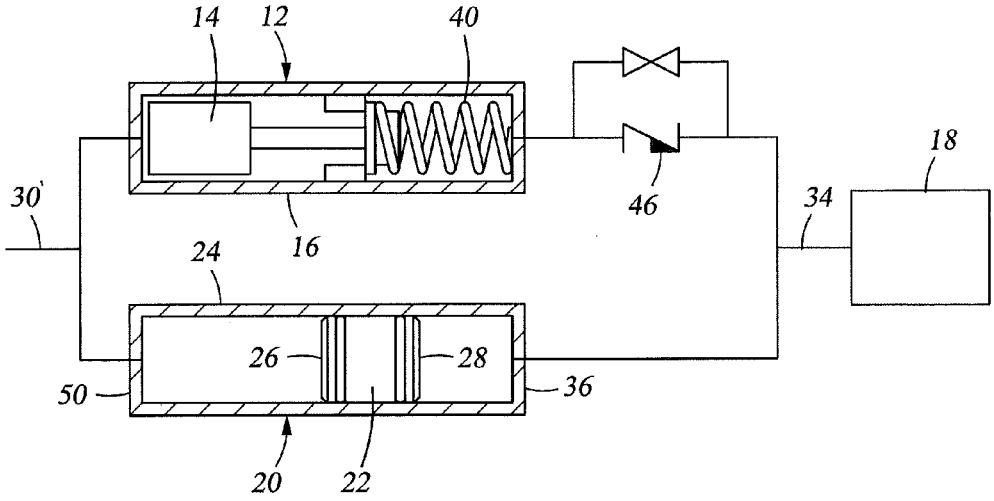
FIG. 1 is a schematic representation of a hydraulic activation system as disclosed herein in a non actuated position.

Referring to FIG. 1, a system 10 having the capability of improving precision control in hydraulic actuation is illustrated. The system 10 as disclosed herein comprises two subconcepts that may be used together or separately. The drawing Figures illustrate both together but it is to be understood that the concepts may be used separately with improved hydraulic precision being the result but potentially less precision than if both concepts are employed together. The concepts are 1) accounting for thermal and or pressure change in the system or the hydraulic fluid or both; and 2) accounting for compliance in the system. Using for example, a downhole hydraulically actuated tool system, it is necessary in order to achieve precision control, to accommodate a wide range of temperatures and pressures. Hydraulic fluid properties are greatly affected by both temperature and pressure. For example, a fluid's viscosity may change an order of magnitude over a temperature range of 300 F. A fluid's bulk modulus may change by a factor of two or more over an operating pressure of 0-10,000 psi. These large changes make it difficult to obtain precise control of a hydraulic system. Further, compliance within the system being actuated can absorb a consequential volume of hydraulic fluid and hence reduce the actual actuation achieved by an appreciable amount. Compliance in the system comes from many places including but not limited to seal movement, seal compressibility and expansion, chamber expansion, etc. Often such effects are non linear and are also dependent upon both the pressure and temperature.

In some systems, a fluid metering valve such as a spool valve 12, for example, is used to meter a specific amount of hydraulic fluid for a particular desired actuation, which may be a complete actuation in itself or may be an incremental actuation of a system. While other metering components are contemplated herein, a spool valve is an illustrative component to enhance understanding of the system being disclosed. Generally, spool valves do not contain any seals and instead use a tight tolerance labyrinth to inhibit fluid flow past the spool of the spool valve. Inherent in all spool valves so configured is a by-pass flow rate that passes around the spool within the spool valve. The rate is dependent upon fluid properties and in most applications can be managed relative to the time and displacement of the spool travel such that the total by-pass fluid volume is negligible relative to the volume of the fluid displaced by the traveling spool. However, in applications subject to large temperature changes where the fluid viscosity changes significantly, the by-pass flow can become significant. Generally the spool valve's by-pass flow rate (Df) is inversely proportional to the viscosity (v) and proportional to the diametrical clearance (d) to the third power or Df~(d^3)/v. The equation makes clear that a viscosity change of any significant amount will herald a significant change in by-pass flow rate and thereby a reduction in effective precision of metered fluid. The system 10 addresses these issues to substantially improve precision of actuation in hydraulic systems and particularly those experiencing largely changing temperature and pressure environments.

Temperature accommodation of the system 10 is directed to addressing the proportionality of the change in by-pass flow to the change in temperature by automatically adjusting a diametrical clearance between a spool 14 and a sleeve 16 of a spool valve 12. Because the by-pass flow rate is proportional to the diametrical clearance to the third power, relatively small changes in that clearance are required to offset large changes in the viscosity.

To achieve changes in the diametrical clearance between the spool 14 and the sleeve 16, the spool is configured with a dissimilar coefficient of thermal expansion to that of the rest of the valve 12. Upon exposure to temperature that acts upon the spool valve 12, the spool 14 expands at a greater rate than the rest of the valve 12. Accordingly, the diametrical clearance between the spool 14 and the sleeve 16 necessarily is reduced so that a relatively constant by-pass flow rate across the temperature range is maintained in the valve 12. In one embodiment the spool is fabricated from Inconel metal with a coefficient of thermal expansion of 7.22×10^6 in/in/F and the sleeve 16 that it travels within is fabricated from 440 C metal with a coefficient of thermal expansion of 5.56×10^6 in/in/F. Hence as the temperature of the system increases the spool 14 expands more than the sleeve 16 and the diametrical clearance becomes smaller. As will be appreciated from the above, the tighter clearance will substantially negate the increase in fluid by-pass concomitant the reduction in viscosity of the fluid due to temperature. While Inconel and 440 C were given in the present example, one skilled in the art will recognize that other materials can be used. The materials used will be dependent upon but not limited to the initial clearance at ambient conditions, the desired by-pass flow rate, fluid material properties and range of operating pressures and temperatures. Materials include but are not limited to metals, ceramics, plastics and epoxy such as steel, stainless steel, monel, nickel alloys, tungsten, tungsten carbide, berrylium copper, copper alloys, zinc alloys, thermoplastics, thermoset plastics, alumnina and zirconia.

The second concept identified above relates to system compliance compensation. The compensation system operates hydraulically in parallel with the metering valve but does not require that the metering valve comprise a temperature accommodating construction. In operating hydraulic tools, for example a downhole flow control device 18 as schematically illustrated in FIG. 1, there is a certain amount of system hydraulic compliance associated with seals moving in their glands, compression of the seals, expansion of the components due to pressure and bulk compression of the actuating hydraulic fluid. These factors are generally impacted by both pressure and temperature such that the amount of hydraulic compliance depends on the system operating temperature and pressure. When delivering a specific amount of fluid to a hydraulic system, a portion of the fluid goes to system compliance while the remaining fluid is used to perform the desired work. Since the system compliance is a function of the operating pressure and temperature, it is difficult to provide consistent work over a wide range of pressures and temperatures.

Figure 2:
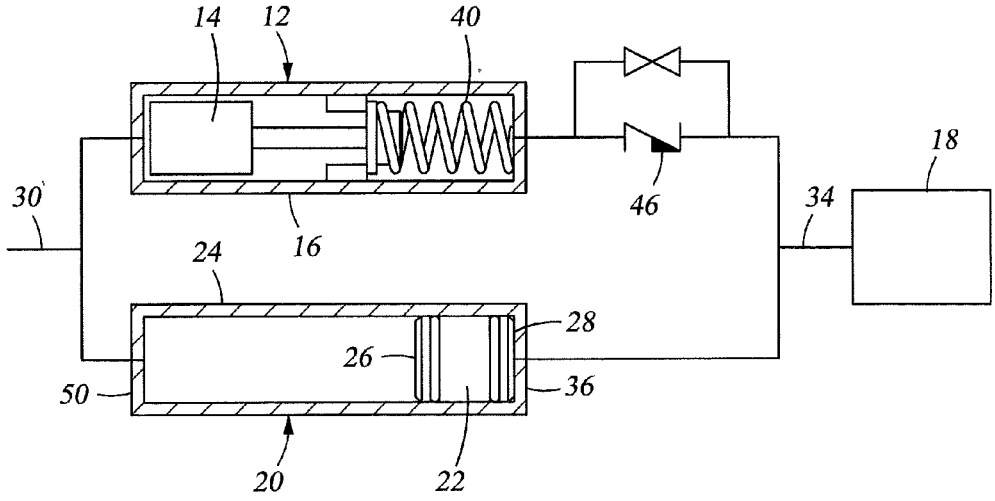
FIG. 2 is a schematic representation of a hydraulic activation system as disclosed herein in a pressured position.

Still referring to FIG. 1, a floating piston arrangement 20 addresses the compliance issue by supplying a separate semi-self regulating amount of fluid to account for system compliance. Arrangement 20 comprises a floating piston 22 sealingly (such as by O-rings as is well known to those of skill in the art) disposed within a housing 24. The piston 22 is exposed at one end 26 to control line pressure from a control line 30 and at another end 28 to fluid pressure existing within a component to be actuated (not shown) and fluidly connected thereto by a line 34. Referring to FIG. 2, the floating piston, in one embodiment, starts in a position adjacent an end 36 of the housing 24 farthest from the control line 30 such that when pressure is applied through control line 30 there will be no movement of piston 22 since it is hard against an opposing end of the housing 24. In this embodiment pressure from control line 30 is directed only to the spool 14 and once the appropriate pressure is arrived at, the spool 14 will move thereby metering a volume of fluid to the end device. Some of this fluid will be taken up as compliance and hence the full actuation increment intended by the construction of the spool valve 12 is not achieved on the first actuation sequence. Subsequent actuation sequences will be complete increments due to the action of piston 22, discussed more fully hereunder in conjunction with an alternate embodiment.

In another embodiment, the piston 22 may be at another position within the housing 24. In embodiments where the piston is other than at end 36, an amount of hydraulic fluid will be within the housing 24 adjacent end 28 of piston 22. This fluid is to be estimated to be a correct amount of fluid to take up compliance within the end device when subject to the conditions (temperature, pressure) where the device is expected to be actuated. In such an embodiment, the first actuation will substantially avoid compliance related reduced actuation but rather will be a substantially complete actuation increment. This is because the fluid volume within housing 24 will be preferentially squeezed back into the end device pursuant to fluid pressure in line 30. In operation, as the control line pressure 30 is increased, the pressure at the control line 30 side of the spool 14 and the pressure at the control line 30 side of the piston 22 increase simultaneously. Because the piston 22 floats, the piston imposes the pressure of the control line 30 to the actuation control line 34 such that pressures in control line 30 and control line 34 are close to the same pressure. The pressure in control line 30 is increased above the pressure in control line 34 causing movement of the piston 22, thereby re-equalizing pressures, until the piston 22 contacts end 36 of the housing 24, at which time, the end device 18, for example downhole flow control valve, is compliance compensated. The actuation pressure in control line 34 also acts on check valve 46 and prevents any fluid from moving into the spool valve 12 from the control line 34 side of the spool valve 12. In order for the spool 14 to move, the control line pressure 30 must exceed both the fluid pressure existing at the control line 34 side of the spool 14 and the a spring 40 preload. During the time that the spool is not moving, the control line pressure 30 will by-pass around the spool and maintain the pressure below the spool at the relatively same pressure as the control line pressure. This configuration ensures that the spool 14 will not begin to move until end device 18 compensation has been achieved as signaled by the piston 22 shouldering at end 36 of housing 24. Once the piston 22 shoulders and has supplied the fluid to compensate for the end device compliance, continued control line pressure increase will cause pressure at the control line 30 side of the check valve 46 to exceed the pressure at the control line 34 side of the check valve 46 creating a condition that allows the spool to deliver fluid to the end device 18. As the pressure continues to increase, the spool will begin to move and deliver the fluid to actuate the end device 18.

Figure 3:
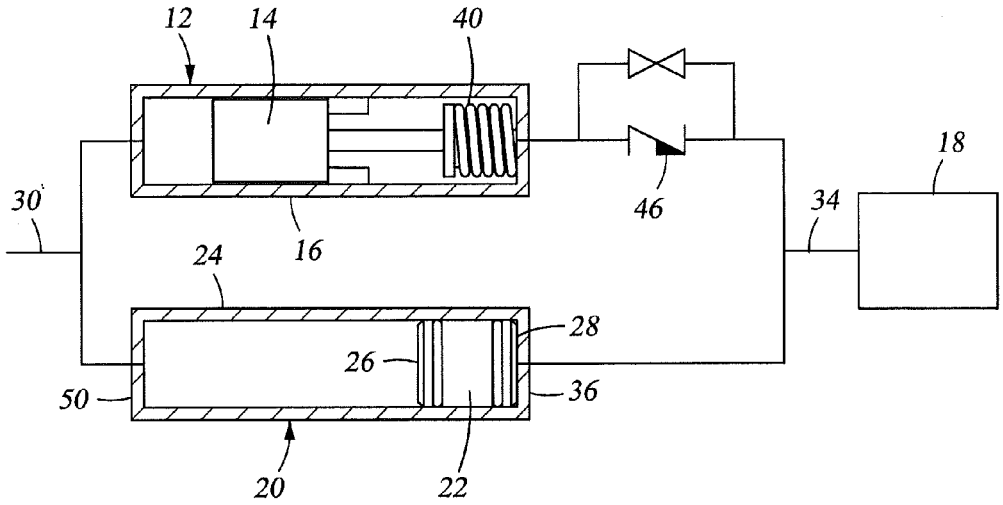
FIG. 3 is a schematic representation of a hydraulic activation system as disclosed herein in a measured actuation position.

Having explained operation of the two concepts, the operation ofthe system 10 as illustrated in FIGS. 1-4 simultaneously will be helpful. As pressure is applied to system 10 through control line 30, and depending upon the position of the piston 22, either the piston will move preferentially or the spool 14 will move if the piston 22 cannot (because it is already against end 36). If the piston 22 is not against end 36 the piston will respond to the pressure in control line 30 because that is the only force with which it must contend. The spool 14 on the other hand also must contend with the spring 40 urging the spool in the opposite direction to the direction the fluid pressure in line 30 is urging it. Once the piston 22 does come into contact with end 36, the spool 14 will begin to move. At this point the pressure drop across the spool 14 is equivalent to a spring 40 preload acting against movement of the spool 14. As the spool 14 is displaced, the pressure below the spool increases until the actuation pressure of the end device is achieved. During this initial movement, the system compliance will be offset by a portion of the volume of fluid displaced by the spool, providing that the piston 22 was at end 36 initially. Once the actuation pressure is achieved, the spool valve will stroke, compressing the spring 40 and seating a poppet valve 42 against a poppet seat 44 to displace a specific amount of fluid through a check valve 46. The poppet valve 42 on the poppet seat 44 creates a hard stop for fluid movement and allows a pressure spike to signal that the spool 14 has completed its movement. The fluid displaced by the spool 14 actuates the end device another increment. The position of the system 10 at this point in the operation thereof is illustrated in FIG. 3.

Figure 4:
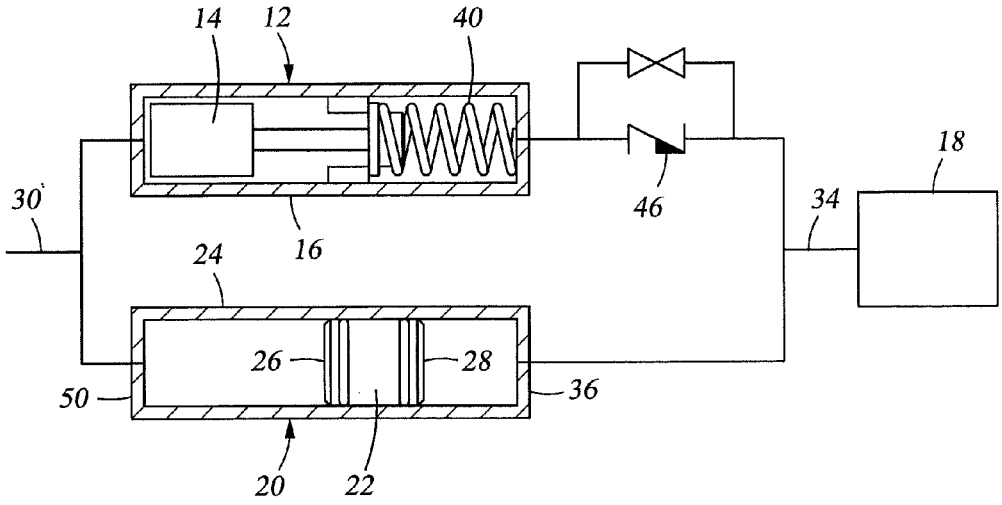
FIG. 4 is a schematic representation of a hydraulic activation system as disclosed herein in a bleed off position.

After the increment is completed, pressure in line 30 is bled off, see FIG. 4. Upon such action, the spool will first begin to move toward an end 48 of the sleeve 16 based upon a spring force of spring 40 and the bypass rate around the spool 14 from fluid in control line 30. Because of the check valve 46, pressure from the end device through line 34 does not reach and move spool 24. Rather that pressure and volume of fluid is directed to the floating piston 22, which is moved in the housing 24 toward end 50 of housing 24. The volume of fluid accordingly moving into the housing 24 is substantially the amount that is related to compliance in the end device. Therefore, upon a subsequent actuation, the volume that is related to compliance is put back into the end device before the measured actuation volume is applied.

As noted above, greater precision is obtained if the thermal concept and the compliance concept are both used at the same time.

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. A hydraulic actuation system comprising:

a metering valve; and a piston arrangement hydraulically in parallel with the metering valve, the system configured to preferentially move the piston to precharge an end device with hydraulic fluid prior to supplying hydraulic fluid of a specific volume defined by the metering valve in parallel to the end device.

2. A hydraulic actuation system as claimed in claim 1 wherein the metering valve includes a sleeve and a spool, the spool including a material having a higher coefficient of thermal expansion than that of the sleeve.

3. A method for actuating a hydraulic end device comprising:

pressuring a control line with parallel hydraulic access to a metering valve and a floating piston arrangement;

stroking a piston of the piston arrangement if the piston arrangement is in a position that allows stroking; and stroking the metering valve after the piston arrangement is in a position that prevents further stroking of the piston to supply a specific volume of fluid defined by the metering valve to the end device.

4. A method as claimed in claim 3 wherein the volume of fluid supplied to an end device that is associated with an incremental actuation of the end device.

5. A method as claimed in claim 3 further comprising:

depressurizing the control line;

preventing fluid movement to the metering valve;

moving the piston to accommodate in the piston arrangement a volume of hydraulic fluid associated with compliance in the end device.

6. A hydraulic actuation system comprising:

a downhole flow control device;

a metering valve in hydraulic communication with the downhole flow control device; and a piston arrangement hydraulically in parallel with the metering valve, the system configured to preferentially move the piston to precharge the downhole flow control device with hydraulic fluid prior to supplying hydraulic fluid of a specific volume defined by the metering valve to the downhole flow control device.

* * * * *